United States Patent [19]

Wakamiya

[11] Patent Number: 5,052,520

[45] Date of Patent: Oct. 1, 1991

[54] UNDERGROUND LIFT FOR USE IN THE REPAIR OF A VEHICLE

[75] Inventor: Koji Wakamiya, Chita, Japan

[73] Assignee: Sugiyasu Industries Co., Ltd., Takahama, Japan

[21] Appl. No.: 593,062

[22] Filed: Oct. 5, 1990

[30] Foreign Application Priority Data

Jul. 13, 1990 [JP] Japan ..... 2-75003

[51] Int. Cl.[5] ..... B66F 7/28

[52] U.S. Cl. ..... 187/8.67; 187/8.41

[58] Field of Search ..... 187/8.41, 8.67

[56] References Cited

U.S. PATENT DOCUMENTS

| | | | |
|---|---|---|---|
| 3,070,189 | 12/1962 | La Karnafeaux et al. | 187/8.41 |
| 3,094,192 | 1/1963 | McAlpine | 187/8.41 X |
| 3,347,342 | 10/1967 | Hott | 187/8.41 |
| 3,405,781 | 10/1968 | Brown | 187/8.41 |
| 3,420,187 | 1/1969 | Johnson et al. | 187/8.41 |

FOREIGN PATENT DOCUMENTS 62-211299 9/1987 Japan .

*Primary Examiner*—Robert P. Olszewski
*Assistant Examiner*—Dean A. Reichard
*Attorney, Agent, or Firm*—Lahive & Cockfield

[57] ABSTRACT

An underground lift for use in the repair of a vehicle comprises (i) a pair of lifting apparatuses located in a pit and each having a hydraulically-operated ram which can be extended and retracted from and into the pit and (ii) a vehicle support mounted on the ram and including a pair of sliders and a pair of hydraulic actuating members each connected to one of the sliders for moving the slider toward or away from the other slider, each of the sliders including an attachment holder in which a desired attachment for directly supporting a bottom of a vehicle can be removably set. At least one of the lifting apparatuses is movable toward or away from the other lifting apparatus.

2 Claims, 4 Drawing Sheets

UNDERGROUND LIFT FOR USE IN THE REPAIR OF A VEHICLE

FIELD OF THE INVENTION

This invention relates to an underground lift for use in the repair of a vehicle.

BACKGROUND OF THE INVENTION

So far it has been quite troublesome to lift a vehicle by an underground lift which uses attachments for directly supporting the bottom of a vehicle. Firstly, the conventional attachments used for this purpose are not easy to handle because they themselves are sliders which can be removably set in a guide member and, hence, they are quite heavy in weight. Secondly, the conventional attachments, or sliders, are manually moved toward or away from each other. No hydraulic, pneumatic or electric mechanism has been provided to move the sliders. Thus, it has been necessary for a repairman to crawl under the vehicle and manually move the sliders to positions where the sliders can support the vehicle safely.

SUMMARY OF THE INVENTION

Accordingly, it is an object of the invention to provide an underground lift for use in the repair of a vehicle, including sliders which themselves do not directly support a vehicle, but are provided with attachment holders in which desired attachments for directly supporting a vehicle can be removably set.

Another object of the invention is to provide an underground lift for use in the repair of a vehicle, including sliders which are operated, or moved toward or away from each other, by hydraulic actuating mechanisms.

Still another object of the invention is to provide an underground lift for use in the repair of a vehicle, including sliders which are operated from a remote location.

According to the invention, an underground lift for use in the repair of a vehicle is provided which comprises a pair of lifting apparatuses located in a pit and each having a hydraulically-operated ram which can be extended and retracted from and into the pit, at least one of the lifting apparatuses being movable toward or away from the other lifting apparatus, and a vehicle support mounted on the ram and including a pair of sliders and a pair of hydraulic actuating members each connected to one of the sliders for moving the slider toward or away from the other slider, each of the sliders including an attachment holder in which a desired attachment for directly supporting a bottom of a vehicle can be removably set.

BRIEF DESCRIPTION OF THE DRAWING

In FIG. 2 piston rods are retracted to position sliders of the vehicle support in proximity to each other;

DETAILED DESCRIPTION OF A PREFERRED EMBODIMENT

Figure 1:
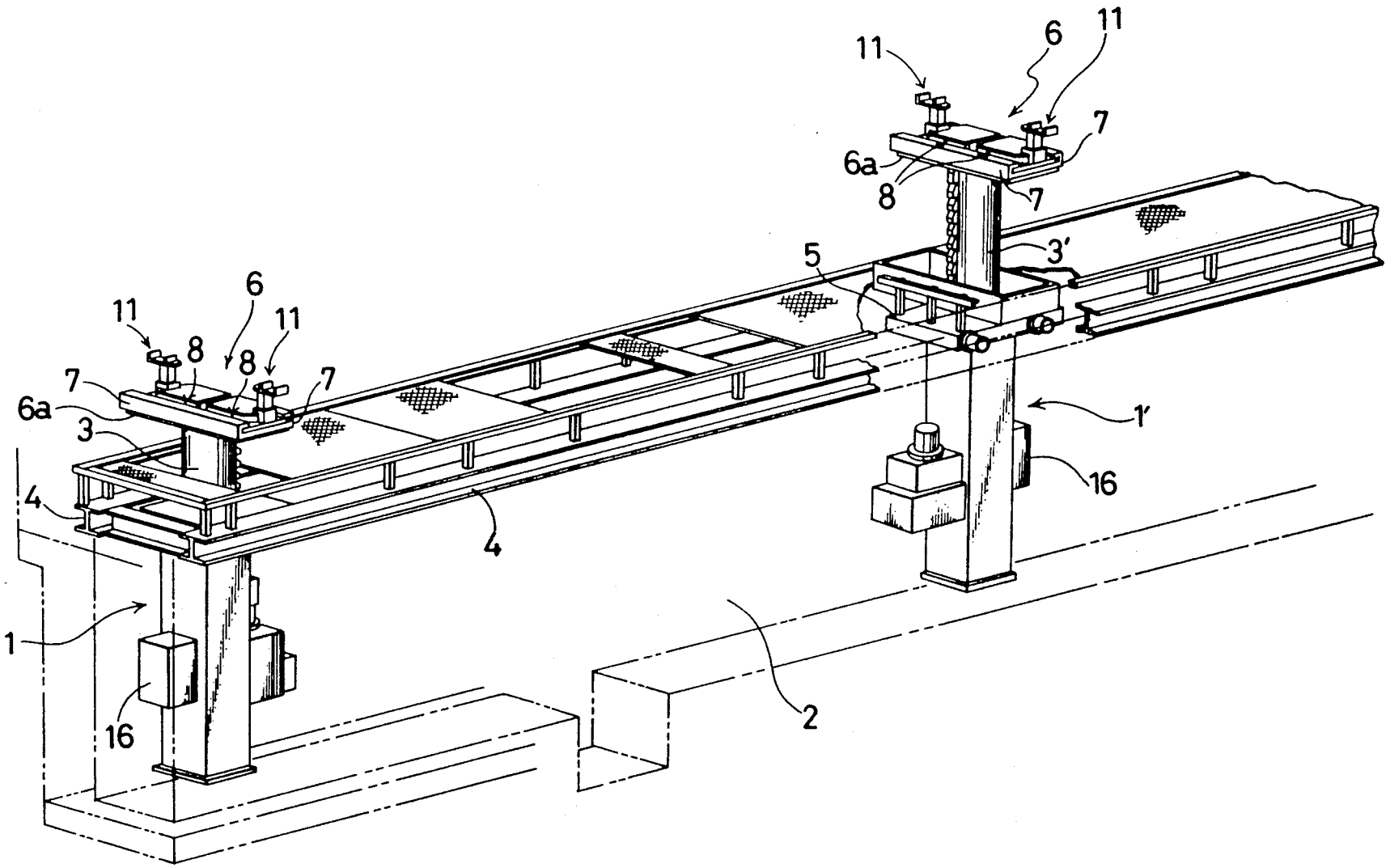
FIG. 1 is a perspective view of an underground lift according to the invention.

Referring now to the drawing, an underground lift for use in the repair of a vehicle which embodies the invention in one preferred form includes a pair of spaced-apart lifting apparatuses 1 and 1' located in a pit 2. A pair of opposed I-shaped rails 4 are fixed to opposed upper portions of the wall of the pit 2, respectively. The front lifting apparatus 1 is fixed to the interior surfaces of the rails 4 at an upper portion thereof. The rear lifting apparatus 1, has a plate 5 which is supported by the rails 4 and is movable along the rails 4. Thus the rear lifting apparatus 1' is movable along the rails 4 toward or away from the fixed lifting apparatus 1 as the plate 5 is guided by the rails 4.

Each lifting apparatus has a ram 3 or 3' which is vertically movable, that is, which can be extended or retracted from or into the pit 2. The ram is extended or retracted either independently of or synchronously with each other by a hydraulic circuit (not shown). A vehicle support 6 is mounted on the ram. The vehicle supports 6 on the rams 3 and 3' have identical construction.

Figure 2:
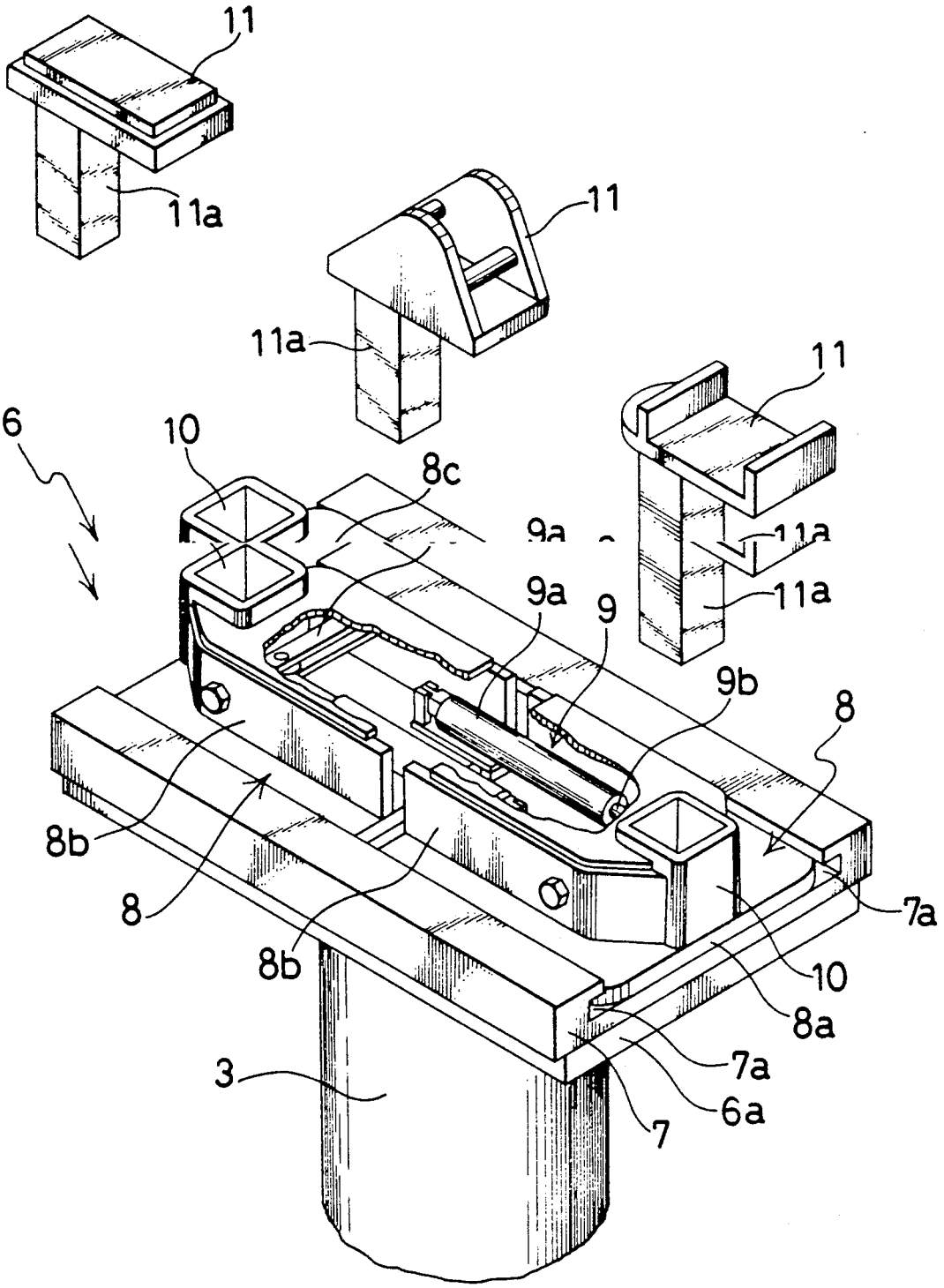
FIG. 2 is a perspective view of a vehicle support mounted on a ram.
Figure 3:
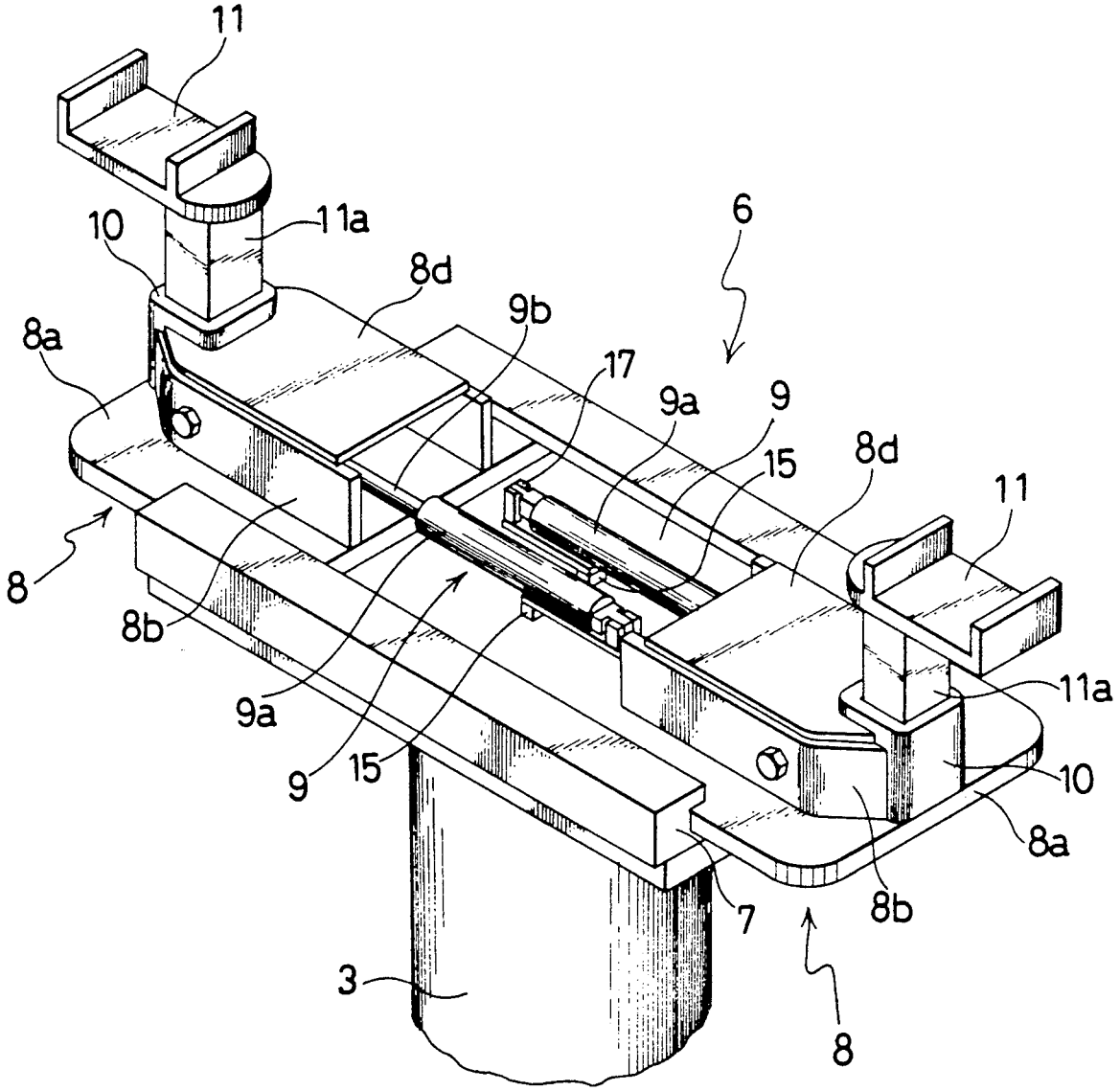
In FIG. 3 the piston rods are extended to move the sliders away from each other.

The vehicle support 6 includes a rectangular base plate **6*a* which is fixed to the top of the ram and is located in a direction perpendicular to the length of the pit 2. As best shown in FIGS. 2 and 3, a hollow guide member 7 is located on the base plate 6*a*. The guide member 7 has an open top and opposed sides. Also, the guide member 7 has opposed inner guide grooves 7*a* along opposed closed sides thereof. A pair of opposed sliders 8 are provided on the guide member 7. The sliders 8 are arranged symmetrically to each other. Each slider 8 includes a bottom plate 8*a* resting on the bottom of the guide member 7 and having opposed sides slidably received in the respective guide grooves 7*a* of the guide member 7. The slider 8 also includes a frame 8*b* fixedly mounted on the bottom plate 8*a*. A cover plate 8*d* is secured to the frame 8*b*. Also, an attachment holder 10 is fixedly mounted on the bottom plate 8*a***.

Two actuating members 9 are connected to the respective sliders 8. Each actuating member 9 includes a cylinder **9*a* and a piston rod 9*b*. The cylinder 9*a* is located above the bottom of the guide member 7, but is connected to the bottom of the guide member 7 through a mount piece 15. One end of the piston rod 9*b* is connected to a support member 8*c* which is fixed to the frame 8*b* of one of the sliders 8. The cylinder 9*a* is so spaced from the bottom of the guide member 7 as to allow the bottom plate 8*a* of the other slider 8 to enter between the cylinder 9*a* and the bottom of the guide member 7**.

Figure 4:
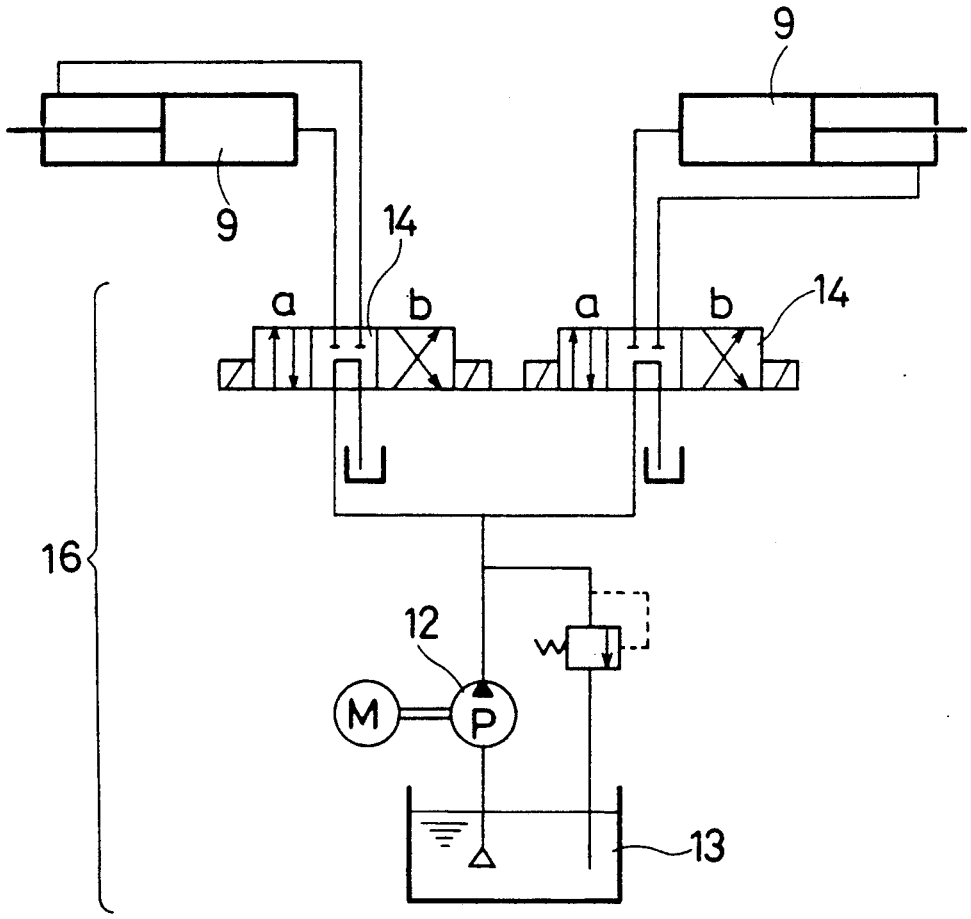
FIG. 4 shows a hydraulic circuit for operating the piston rods.

The actuating members 9 are operatively connected to a hydraulic circuit 16 of FIG. 4 which is fixed to the lifting apparatus in the pit 2 (FIG. 1). The hydraulic circuit 16 includes a pair of selector valves 14, an oil pump 12 and a tank 13. The selector valves 14 are operatively connected to the respective actuating members 9. The hydraulic circuit 16 is operatively connected to a remotely located switch (not shown) which is operated to extend or retract the piston rods **9*b* of the two actuating members 9** independently of each other.

When the piston rod **9*b* is extended or retracted, the associated slider 8 moves away from or toward the other slider 8**.

In use, attachments 11 for directly supporting the bottom of a vehicle are set in the attachment holders 10.

As illustrated in FIG. 2, various attachments 11 with different shapes may be prepared to support various types of vehicles. For the attachments 11 to be firmly held in the attachment holder 10, however, it is necessary that the attachments 11 have identical legs 11*a* with shapes similar to the inner space of the attachment holder 10.

Attachments 11 with shapes most suitable for a particular vehicle to be repaired may be selected and set in the attachment holders 10 in advance. Initially the rams 3 and 3' of the lifting apparatuses 1 and 1' are retracted in the pit 2. To start with, the vehicle is driven onto the pit 2. Then, the rear lifting apparatus 1' is moved toward or away from the front, fixed lifting apparatus 1 to locate the rear lifting apparatus 1' in a position where the rear lifting apparatus 1' can lift the vehicle safely together with the front lifting apparatus 1. Then, the actuating members 9 associated with the front lifting apparatus 1 as well as the actuating members 9 associated with the rear lifting apparatus 1' are remotely operated to move the opposed sliders 8 to positions where the attachments 11 thereon can safely support t of the vehicle. To be more exact, the opposed slider 8 are moved to positions where the attachments 11 thereon can engage appropriate opposed side portions of the vehicle bottom to safely support the vehicle bottom. Then, the rams 3 and 3' are extended to lift the vehicle. The attachments 11 thus engage with the bottom of the vehicle and lift the vehicle.

When the attachments 11 are lifting the vehicle in this manner, the sliders 8 may flex slightly. Hence, the piston rod 9*b* is pivotally connected to the support member 8*c*, and one end of the cylinder 9*a* is also pivotally connected to a support piece 17.

It is possible either to support a front portion of the vehicle by the front lifting apparatus 1 and a rear portion thereof by the rear lifting apparatus 1' or to support the vehicle in the reversed manner.

If desired, a front lifting apparatus movable toward or away from the rear lifting apparatus 1' may be used instead of the illustrated fixed front lifting apparatus 1. Also, air cylinders may be used instead of the hydraulic actuating members 9. Moreover, it is possible to omit the hydraulic actuating members 9 and the mechanism associated therewith and instead provide an electric motor to operate the sliders 8.

According to the invention, it is very easy to replace the attachment 11 with another one, chiefly because the attachment 11 is relatively small in size and, hence, is relatively light in weight. In addition, it is not necessary to crawl under the vehicle to adjust the sliders 8, but the sliders 8 are adjusted from a remote location.

What is claimed is:

1. In an underground lift for use in the repair of a vehicle, including (i) a pair of lifting apparatuses located in a pit and each having a hydraulically-operated ram which can be extended and retracted from and into the pit and (ii) a vehicle support mounted on the ram and including a pair of sliders which can be moved toward or away from each other, at least one of said lifting apparatuses being movable toward or away from the other lifting apparatus, the improvement wherein each vehicle support further includes a pair of hydraulic actuating members each connected to one of the sliders and adapted for independently moving each slider toward or away from the other slider to position the sliders for safely and supportingly engaging the bottom of the vehicle, and wherein each of the sliders comprises an attachment holder and an attachment, wherein the attachment holder is adapted for removably and replacably holding one of a set of attachments having varying vehicle-engaging shapes suitable for directly supporting a bottom of a vehicle.

2. An underground lift for use in the repair of a vehicle, comprising:

(i) a pair of lifting apparatuses located in a pit and each having a hydraulically-operated ram which can be extended and retracted from and into the pit, at least one of the lifting apparatuses being movable toward or away from the other lifting apparatus, and (ii) a vehicle support mounted on each ram and including a pair of sliders and a pair of automatically and remotely controlled actuating members each connected to one of the sliders for independently moving each slider toward or away from the other slider to position the sliders beneath the vehicle for safely and supportingly engaging opposed portions of the vehicle bottom, each of the sliders including an attachment holder in which a desired attachment for directly supporting a bottom of a vehicle can be removably and replacably set.

* * * * *